US010422151B1

(12) United States Patent
Garcia

(10) Patent No.: US 10,422,151 B1
(45) **Date of Patent: *Sep. 24, 2019**

(54) COLUMBARIUM ASSEMBLY

(71) Applicant: COLUMBARIUM BY DESIGN, LLC, Santa Fe, NM (US)

(72) Inventor: Gerardo G. Garcia, Santa Fe, NM (US)

(73) Assignee: COLUMBARIUM BY DESIGN, LLC, Santa Fe, NM (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/170,839

(22) Filed: Oct. 25, 2018

Related U.S. Application Data

(63) Continuation of application No. 15/919,446, filed on Mar. 13, 2018, now Pat. No. 10,138,650.

(51) Int. Cl.
*E04H 13/00* (2006.01)

(52) U.S. Cl.
CPC ..... *E04H 13/006* (2013.01)

(58) Field of Classification Search
CPC ..... E04H 13/00; E04H 13/006; E04H 13/008
USPC ..... 27/35; 52/134, 136
See application file for complete search history.

(56) References Cited

U.S. PATENT DOCUMENTS

| | | | |
|---|---|---|---|
| 2,574,938 | A | 11/1951 | Sinner |
| 2,618,145 | A | 11/1952 | Sinner |
| 3,754,805 | A | 8/1973 | Pangbum |
| 3,841,726 | A | 10/1974 | Andros |
| 3,905,169 | A | 9/1975 | Gallo |
| 3,990,199 | A | 11/1976 | Gallo |
| 4,614,066 | A | 9/1986 | Koppenberg |
| 5,953,865 | A | 9/1999 | Rickards |
| 8,122,650 | B2 | 2/2012 | Eickhof |
| D745,820 | S | 12/2015 | Alvarez Brena |
| D750,955 | S | 3/2016 | Alvarez Brena |
| 9,414,985 | B2 | 8/2016 | Ugartechea Berlanga |
| D773,293 | S | 12/2016 | Ugartechea Berlanga |
| 2007/0261331 | A1 | 11/2007 | Rickards |
| 2008/0078074 | A1 | 4/2008 | McCampbell |
| 2010/0300016 | A1 * | 12/2010 | Eickhof ..... E04H 13/006 52/136 |

(Continued)

OTHER PUBLICATIONS

U.S. Appl. No. 15/919,446, filed Mar. 13, 2018 (Parent application).

(Continued)

*Primary Examiner* — William L Miller
(74) *Attorney, Agent, or Firm* — Amin, Turocy & Watson, LLP

(57) ABSTRACT

A columbarium system and corresponding method of assembly is disclosed. The columbarium system includes niche cabinets, braces, brackets, face plates, and face plate security hardware. The niche cabinets are stackable in columns and rows to form a columbarium. The braces fit between front lip segments of adjacent niche cabinets. The brackets comprise bracket arms and face plate knobs. Bracket arms extend into braces, and face plate knobs support face plate corners. Face plates cover front sides of each niche cabinet. Face plates are supported and positioned by the face plate knobs, and face plates are secured in place by face plate security hardware. Shims may be inserted between adjacent niche cabinets to maintain spacing between the backs of niche cabinets.

10 Claims, 4 Drawing Sheets

(56) References Cited

U.S. PATENT DOCUMENTS

| | | | | |
|---|---|---|---|---|
| 2012/0042489 | A1 | 2/2012 | Cai | |
| 2018/0202184 | A1* | 7/2018 | Rossi | E04H 13/008 |
| 2018/0223558 | A1* | 8/2018 | Birkmeier | E04H 13/008 |

OTHER PUBLICATIONS

Design U.S. Appl. No. 29/635,196 Inventor Gerardo G. Garcia, filed Jan. 29, 2018.
Design U.S. Appl. No. 29/646,099, Inventor Gerardo G. Garcia, filed May 1, 2018.
Columbarium by Design, Product Catalog, Feb. 2016.

* cited by examiner

COLUMBARIUM ASSEMBLY

CROSS-REFERENCE TO RELATED APPLICATION

This is a continuation which claims priority of U.S. patent application Ser. No. 15/919,446, entitled "COLUMBARIUM SYSTEM" filed on Mar. 13, 2018. The prior application is incorporated by reference herein.

BACKGROUND

A columbarium is a structure for storing ashes from cremation of the dead. The typical columbarium may be found, e.g., in a church or cemetery, and comprises multiple niches. Each niche is a cabinet in which ashes of a particular person or family may be stored. The niches are typically arranged in multiple columns and rows.

Cremation of human and animal remains is on the rise worldwide, resulting in an increased demand for *columbaria*. There are a number of important criteria in the design of *columbaria*. For example, *columbaria* should be sturdy, long lasting, tamper proof, weatherproof, cost effective, fault tolerant, and customizable to fit individual site designs. There is a need in the industry for a columbarium system which meets these and other design objectives.

SUMMARY

A columbarium system and corresponding method of assembly is disclosed. In some examples, the columbarium system may comprise a plurality of five-sided niche cabinets which are stackable in columns and rows to form a columbarium.

Each niche cabinet may have an open front end surrounded by a front lip extending therefrom. A plurality of braces may each fit between front lip segments of adjacent niche cabinets. The braces may be secured at the corners of the niche cabinets by brackets.

Each bracket may comprise bracket arms and a face plate knob. Each of the arms may extend into a brace, and the face plate knob may extend outwardly away from the brackets to support face plate corners. The face plate knobs may also comprise face plate positioning dividers, in order to guarantee proper face plate spacing.

A face plate may cover a front side of each niche cabinet. Each face plate may be supported and positioned by face plate knobs on brackets adjacent to the niche cabinet. Face plates may be secured in place by face plate security hardware, referred to herein as face plate security assemblies. Each face plate security assembly may attach to a bracket face plate knob. The face plate security assemblies may extend over portions of face plates, in order to secure the face plates against adjacent braces. Further aspects of the invention are shown in the attached pictures and described below.

BRIEF DESCRIPTION OF THE DRAWINGS

Various features and attendant advantages of the disclosed technologies will become fully appreciated when considered in conjunction with the accompanying drawings, in which like reference characters designate the same or similar parts throughout the several views, and wherein.

DETAILED DESCRIPTION

Figure 2:
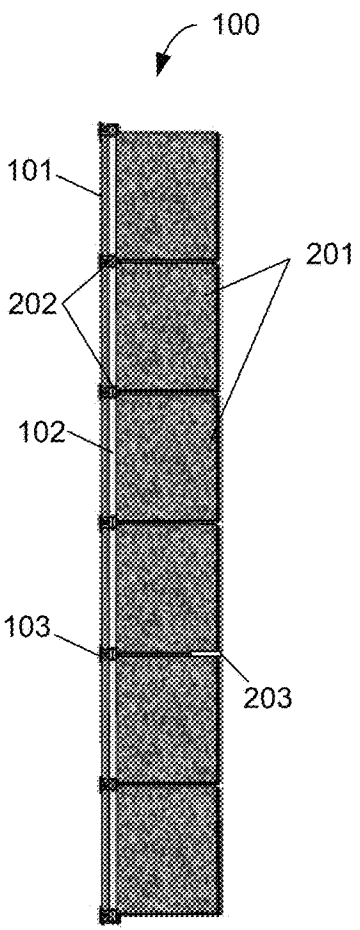
FIG. 2 is a side view of the example columbarium.

Prior to explaining embodiments of the invention in detail, it is to be understood that this disclosure is not limited to the details of construction or arrangements of the components and method steps set forth in the following description or illustrated in the drawings. Embodiments of this disclosure are capable of other embodiments and of being practiced and carried out in various ways. Also, it is to be understood that the phraseology and terminology employed herein are for the purpose of the description and should not be regarded as limiting.

A novel columbarium system and corresponding method of assembly is disclosed. The columbarium system may be used to build *columbaria* having an unlimited number of different designs. For example, *columbaria* built using the disclosed columbarium system may comprise any number of columns and rows, and may be flat/planar in shape or may have non-linear contours. The columbarium system includes a number of features, including for example: niche cabinets, braces, brackets with face plate knobs, face plates, and face plate security assemblies. In some embodiments, all of the disclosed features may be incorporated into a columbarium system. However, it will be appreciated by those of skill in the art that any one of the disclosed features, or any subset of the disclosed features, may also be incorporated into other columbarium systems. Likewise, the features disclosed herein may be modified, removed, or supplemented by other columbarium system features. Therefore, the invention is not limited to the disclosed combination of features, but instead extends to any individual one of, or any subset of, the novel columbarium system features disclosed herein.

Figure 1:
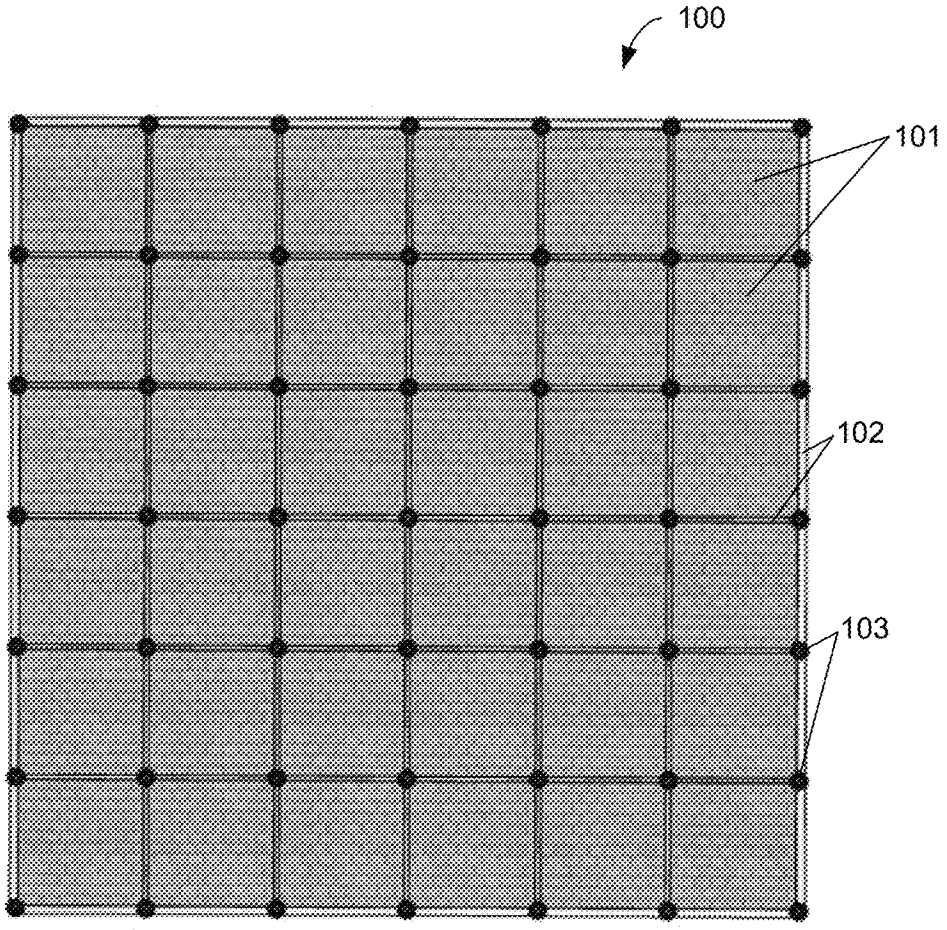
FIG. 1 is a front view of an example columbarium made from the disclosed columbarium system.

FIG. 1 is a front view of an example columbarium made from the disclosed columbarium system, in accordance with some embodiments of the present disclosure. FIG. 1 illustrates a columbarium 100, comprising a plurality of niche cabinets (not visible in FIG. 1) which are stacked in columns and rows. The front ends of the niche cabinets are covered by face plates 101, as seen in FIG. 1. The face plates 101 are secured against braces 102, at least in part by face plate security assemblies 103.

FIG. 2 is a side view of the example columbarium 100, in accordance with some embodiments of the present disclosure. In FIG. 2, the stacked niche cabinets 201 are visible. Likewise, FIG. 2 provides a side view of the face plates 101, braces 102, and face plate security assemblies 103 introduced in FIG. 1. FIG. 2 furthermore provides a side view of brackets 202 and shims 203. Shims 203 may comprise thin strips of material, e.g., polyethylene, between back ends of adjacent niche rows of cabinets 201. Shims 203 may bear the weight of niche cabinets 201 and maintain spacing between the backs of niche cabinets 201 similar to spacing at the front of niche cabinets 201.

Figure 3:
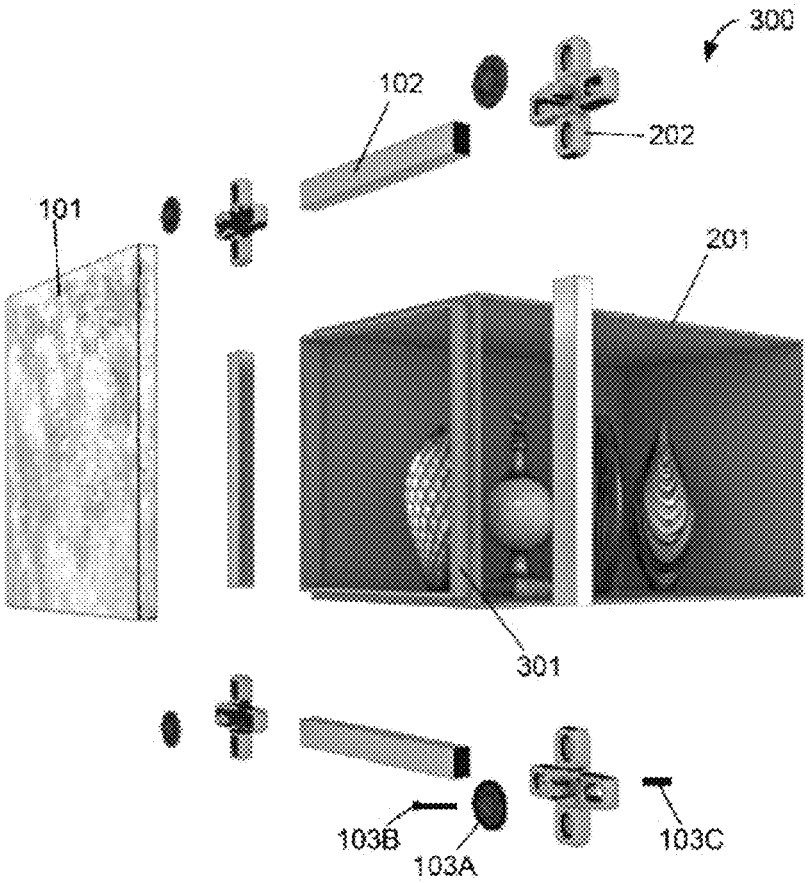
FIG. 3 is an exploded view of example components of the columbarium system.

FIG. 3 is an exploded view of components of the columbarium system, in accordance with some embodiments of the present disclosure. The components described in connection with FIG. 3 may be used to build an individual niche 300, or an entire columbarium 100 such as illustrated in FIG. 1, or an unlimited number of other columbaria having different designs, as will be appreciated. The illustrated components include a niche cabinet 201 comprising a front lip 301, braces 102, brackets 202, a face plate 101, and a face plate security assembly 103A, 103B and 103C.

The columbarium system may comprise a plurality niche cabinets such as 201. The niche cabinets are stackable in multiple columns and rows to form a columbarium. Niche cabinet 201 may be five-sided, comprising a back side, a top side, a bottom side, a right side and a left side, as shown. The right side of niche cabinet 201 is removed from FIG. 3 in order to show contents, such as the illustrated urns, inside of niche cabinet 201. However, it will be appreciated that niche cabinet 201 may generally include five sides, including a right side which is generally identical to the illustrated left side of niche cabinet 201. Niche cabinet 201 may be generally rectangular, although variations are possible (see, e.g., FIG. 5), and niche cabinet 201 is not limited to any particular length, width, or height dimensions. In some embodiments, niche cabinet 201 may be made of a material comprising polyethylene. Niche cabinet 201 may optionally be molded (e.g., by roto-molding or otherwise) as a single individual unit.

Niche cabinet 201 may comprise a front lip 301 extending from a front end of the niche cabinet 201. The front lip 301 has a top segment, a bottom segment, a right segment and a left segment. Each respective segment extends from a respective side (top side, bottom side, right side or left side) of the niche cabinet 201. The segments of the front lip 301 may be inset a distance from the top side, bottom side, right side and left side of the niche cabinet 201, such that the area defined by front lip 301 is smaller than the area defined by the entire front end of the niche cabinet 201.

The columbarium system may further comprise a plurality of braces 102. Four braces 102 are illustrated in FIG. 3, although a columbarium system may comprise any number of braces as appropriate for the number of niche cabinets involved. Each brace 102 comprises a straight tube extending along a front lip segment of niche cabinet 201. The ends of braces 102 may fit over, or otherwise couple with, arms of brackets 202. The arms of brackets 202 may be inserted into braces 102, thereby holding the braces 102 and brackets 202 in place.

Each brace 102 may fit between front lip segments of adjacent niche cabinets, for example, the top brace 102 illustrated in FIG. 3 may fit between the top segment of front lip 301, and a bottom segment of a front lip on a second niche cabinet stacked above niche cabinet 201. Likewise, the left brace 102 may fit between front lip 301 and a niche cabinet to the left of niche cabinet 201, etc.

In some embodiments, the braces 102 may be made of extruded aluminum rectangular tubing. Of course, it will be appreciated that any suitably rigid, strong, and durable material may be appropriate. For example, braces 102 may optionally be made from any shaped or welded metals, or in some embodiments, plastics, woods, or a wide variety of composite materials. The braces 102 may be adapted to be fastened to niche cabinets. For example, sidewalls of braces 102 and, e.g., the front lip 301 of niche cabinet 201 may optionally be pre-drilled with holes so that fasteners, such as rivets or bolt and nut assemblies, may be used to fasten braces 102 in place on niche cabinet 201.

The columbarium system may further comprise a plurality of brackets 202. Four brackets 202 are illustrated in FIG. 3, although a columbarium system may comprise any number of brackets, and different types of brackets, as appropriate for the number of niche cabinets involved and for the desired columbarium design. The brackets 202 fit at front lip segment corners, and each bracket 202 comprises a plurality of arms which extend into or may otherwise couple with braces 202.

Figure 4A:
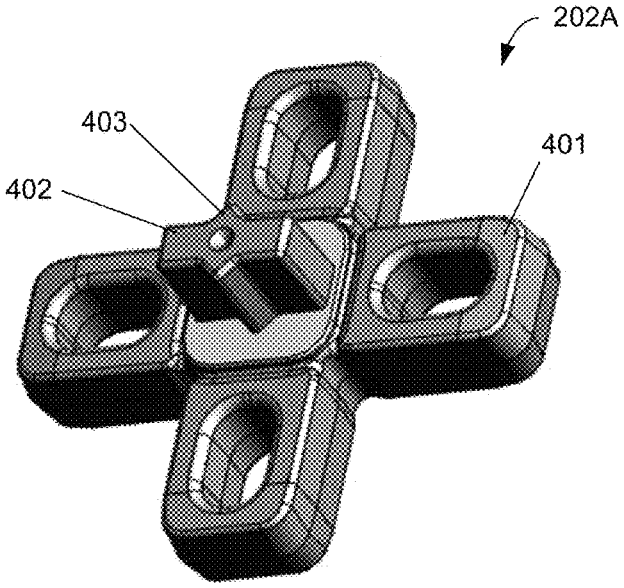
FIGS. 4A, 4B, 4C, and 4D illustrate example brackets which may be included in the columbarium system.
Figure 4B:
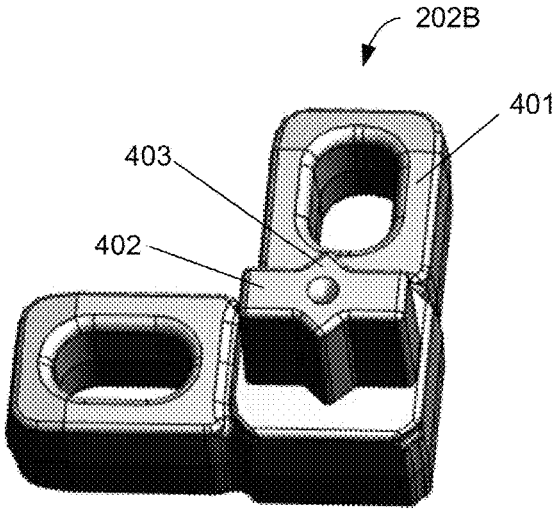
Figure 4C:
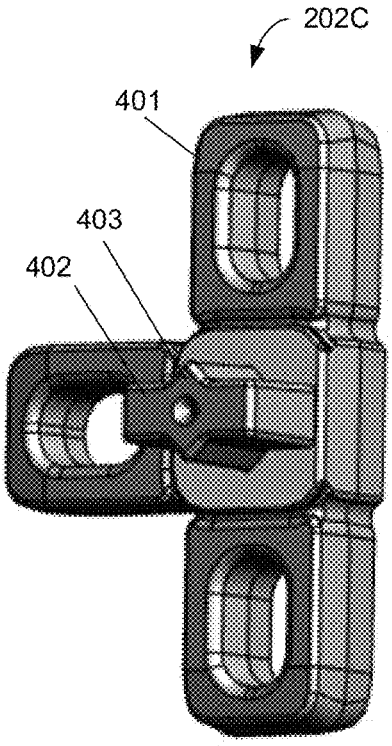
Figure 4D:
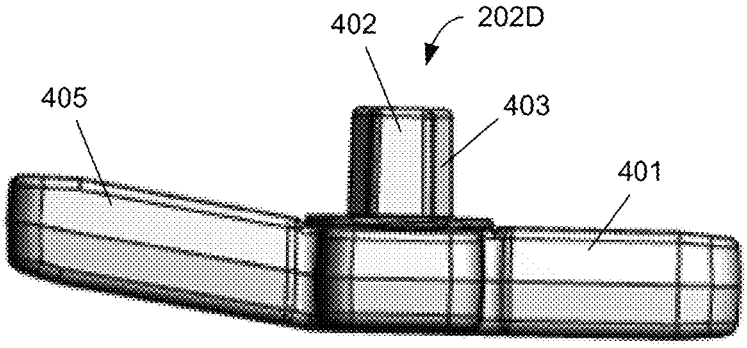

FIGS. 4A, 4B, 4C, and 4D illustrate example brackets which may be included in the columbarium system, in accordance with some embodiments of the present disclosure. FIG. 4A illustrates an example "straight" four arm interior bracket 202A. FIG. 4B illustrates an example "straight" corner bracket 202B. FIG. 4C illustrates an example "straight" edge bracket 202C. FIG. 4D illustrates a side view of an example "single concave" four arm interior bracket 202D.

Each bracket type 202A, 202B, 202C, and 202D includes a plurality of arms 401 and a face plate knob 402. The arms 401 extend orthogonally, at right angles from one another. The face plate knob 402 extends outwardly away from a front side of the niche bracket to support a corner of a face plate 101. The face plate knob 402 also comprises at least one face plate positioning divider 403.

In some embodiments, the face plate knob 402 may be rectangular in shape, as illustrated in FIGS. 4A, 4B, 4C, and 4D, and the face plate positioning divider 403 may comprise a triangular shape, as illustrated. A first divider 403 may extend upwardly from the middle of the face plate knob 402, and a second divider 403 may extend downwardly from the middle of the face plate knob 402. The face plate positioning dividers 403 may have a width, e.g., at the base of the triangles, that substantially matches a height of the face plate knob 402, e.g., the height at the far left or far right side of the face plate knob 402. In some embodiments, the width of the face plate positioning dividers 403 and height of the face plate knob 402 may be, e.g., about ½ inch.

Bracket type 202A, illustrated in FIG. 4A, is an example "straight" four arm interior bracket. Bracket 202A is a "straight" bracket because all of its arms 401 are in a same plane, as illustrated in FIG. 4A. "Straight" brackets may be used to build planar portions of a columbarium. Bracket 202A is a four arm interior bracket because it comprises four arms 401 extending orthogonally outward from a square center portion of the bracket 202A. Four arm interior brackets such as 202A may be deployed at interior connecting points within a columbarium, that is, points at which four corners meet, namely, the four corners of four adjacent niche cabinets 201.

Figure 5:
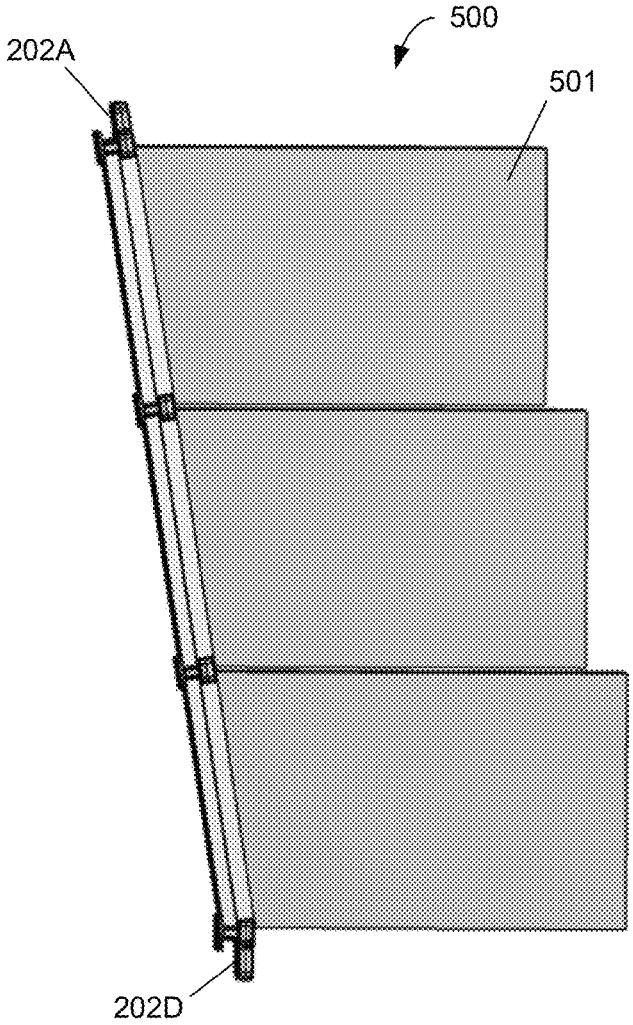
FIG. 5 illustrates niches having angled front ends in order to impart a non-linear shape to a columbarium.

In some embodiments, one or more arms of a bracket may angle forward or backward, such as illustrated in FIG. 4D. FIG. 4D illustrates a side view of an example "single concave" four arm interior bracket 202D. A "single concave" bracket has one arm 405 which is angled forward. Such angled arms 405 support non-linear columbarium shapes. For example, one or more portions of a columbarium may angle forward or backward, towards or away from a viewer standing in front of the columbarium, e.g., as illustrated in FIG. 5.

It will be appreciated with the benefit of FIG. 4D that numerous additional bracket types may be included in the disclosed columbarium system. For example, any of the brackets disclosed herein may be modified to implement "straight", "single concave", "double concave", "single convex", or "double convex" embodiments. Furthermore, the face plate knob 402 may be oriented at a 90° rotation from its illustrated orientation, in any bracket design, to produce still further bracket embodiments. Any subset of bracket types, or all possible bracket types, may optionally be included in a columbarium system in order to support a desired variety of columbarium design possibilities.

Bracket type 202B, illustrated in FIG. 4B, is an example "straight" two arm corner bracket. Bracket 202B is suitable for use at bottom right and top left corners of a columbarium. For bottom left and top right corners, the face plate knob 402 may be oriented at a 90° rotation from its illustrated orientation. Also, one or more arms 401 of bracket 202B may be angled forward or backward, to support non-linear columbarium designs, as described herein.

Bracket type 202C, illustrated in FIG. 4C, is an example "straight" three arm edge bracket. Bracket 202C is suitable for use at right and left edges of a columbarium. For top and bottom edges, the face plate knob 402 may be oriented at a 90° rotation from its illustrated orientation. Also, one or more arms 401 of bracket 202C may be angled forward or backward, to support non-linear columbarium designs, as described herein.

FIG. 5 illustrates niches having angled front ends in order to impart a non-linear shape to a columbarium, in accordance with some embodiments of the present disclosure. The illustrated niche cabinets 501 are generally similar to niche cabinets 201, described herein. Like niche cabinets 201, niche cabinets 501 are stackable in multiple columns and rows to form a columbarium. Niche cabinets 501 may be five-sided, comprising a back side, a top side, a bottom side, a right side and a left side, as shown. Niche cabinets 501 may be generally rectangular, and are not limited to any particular length, width, or height dimensions. In some embodiments, niche cabinets 501 may be made of a material comprising polyethylene. Niche cabinets 501 may optionally be molded (e.g., by roto-molding or otherwise) as a single individual niche cabinet.

Furthermore, niche cabinets 501 may comprise front lips 301 (see FIG. 3) extending from front ends of the niche cabinets 501. The front lip 301 has a top segment, a bottom segment, a right segment and a left segment, each respective segment extending from a respective side (top side, bottom side, right side or left side) of the niche cabinet 501. The segments of the front lip 301 may be inset a distance from the top side, bottom side, right side and left side of the niche cabinet 501, such that the area defined by front lip 301 is smaller than the area defined by the entire front end of the niche cabinet 501.

Unlike niche cabinet 201, niche cabinets 501 may comprise an angled front end in order to impart a non-linear shape to the columbarium. For example, if FIG. 5 is considered as a side view, the top side of each of niche cabinets 501 may be longer than the bottom side, and the front ends of the right and left sides may be formed at an angle. In another orientation, FIG. 5 is considered as a top view, and the left side of each of niche cabinets 501 may be longer than the right side, and the front ends of the top and bottom sides may be formed at an angle.

A "single convex" bracket 202D is illustrated at the bottom of FIG. 5. The illustrated bracket 202D will allow the columbarium shape to transition, e.g., from the illustrated angled section to a planar section (not shown) of flat-faced niche cabinets such as 201, below the illustrated niche cabinets 501. Meanwhile, a "straight" bracket 202D is illustrated at the top of FIG. 5, and so an additional row of angled-face niche cabinets 501 may be stacked on top of the illustrated columbarium section.

Figure 6:
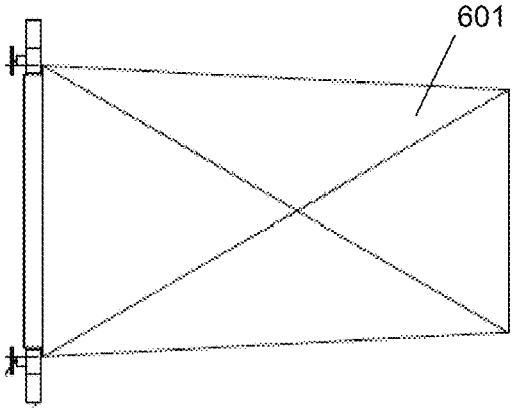
FIG. 6 illustrates a niche having a tapered shape.

FIG. 6 illustrates a niche having a tapered shape, in accordance with some embodiments of the present disclosure. Tapered niche cabinet 601 may generally have many of the properties described herein with respect to niche cabinets 201 and niche cabinets 501. As shown in FIG. 6, the back end of tapered niche cabinet 601 may be smaller in surface area than the front end. When FIG. 6 is considered as a side view, the top and bottom of tapered niche cabinet 601 angle inward, while the right and left sides of tapered niche cabinet 601 are shaped to taper to the back. When FIG. 6 is considered as a top view, the right and left sides of tapered niche cabinet 601 angle inward, while the top and bottom of tapered niche cabinet 601 are shaped to taper to the back. Tapered niche cabinets 601 may be used for example to make rounded portions of columbaria, resulting from stacking multiple rows or columns of tapered niche cabinets 601 adjacent one another.

It will be appreciated that using different bracket types described herein, along with flat-faced niche cabinets 201, angled-face niche cabinets 501, and tapered niche cabinets 601, columbaria may be designed with any desired combination of flat, curved, or angled portions.

With reference to FIG. 3, the columbarium system may further comprise a plurality of face plates 101. One face plate 101 is illustrated in FIG. 3, although a columbarium system may comprise any number of face plates 101, as appropriate for the number of niche cabinets involved and columbarium design. Each face plate 101 covers a front side of a niche cabinet 201. Face plate 101 may comprise, e.g., plexiglas, clear glass, granite, marble, or other sturdy and preferably attractive materials.

Each face plate 101 may be supported and positioned by face plate knobs 402 on brackets 202 adjacent to the niche cabinet 201. For example, each of the four corners of face plate 101 rests against a portion of a face plate knob 402 extending from one of the four brackets 202 surrounding the face plate 101. Face plate 101 may be positioned by the face plate positioning dividers 403 on the brackets 202.

The columbarium system may further comprise a plurality of face plate security assemblies. In FIG. 3, an example security assembly comprises rosette plate 103A, bolt 103B, and sleeve 103C. One face plate security assembly is illustrated in FIG. 3, however a columbarium system may comprise any number of face plate security assemblies, typically one for each bracket 202.

Each face plate security assembly 103A, 103B, and 103C attaches to a bracket face plate knob 402. In the illustrated embodiment, face plate knob 402 may be pre-drilled with a bracket hole extending from the front of the face plate knob 402 through to the back of the bracket 202. The rear portion of the bracket hole may be larger in diameter than the forward portion thereof, allowing the sleeve 103C to fit into the rear portion of the bracket hole, without sliding out of the front of the bracket hole. The sleeve 103C may be inserted in the rear portion of the bracket hole, and the bolt 103B may be inserted into the forward portion of the bracket hole. The bolt 103B passes through the bracket hole to couple with the sleeve 103C disposed opposite the bolt 103B. The bolt 103B and sleeve 103C may be threaded, so the bolt 103B turns into sleeve 103C.

The rosette plate 103A may be attached at the end of bolt 103B, so that as bolt 103B is tightened into sleeve 103C, rosette plate 103A tightens against the face plate 101. Rosette plate 103A extends over portions of adjacent face plates, e.g., face plate 101, in order to secure adjacent face plates 101 against adjacent braces 102.

It will be appreciated that the illustrated face plate security assembly is one example approach to secure face plate 101 against braces 102, and other face plate security assembly configurations may be included in some embodiments. For example, sleeve 103C may be omitted in some embodiments, in favor of a threaded bracket hole. Clips, rivets, or other fasteners may also be substituted for bolt 103B. In some embodiments, sleeve 103C may be inserted in the front of the bracket hole, and secured in place with rivets, welding, adhesive, friction, or other means. A wide variety of security assembly configurations are possible and embodiments of this disclosure are not limited to any particular security assembly configuration.

While various embodiments have been disclosed herein, other aspects and embodiments will be apparent to those skilled in art.

The invention claimed is:

1. A method to assemble a columbarium system, comprising:

stacking a plurality of five-sided niche cabinets, each niche cabinet comprising:

a back side, a top side, a bottom side, a right side and a left side; and a front lip extending from a front end of the niche cabinet, the front lip having a top segment, a bottom segment, a right segment and a left segment;

wherein the niche cabinets are stacked in multiple columns and rows to form a columbarium;

fitting a plurality of braces between the front lip segments of adjacent niche cabinets, each brace comprising a straight tube extending along the front lip segments of adjacent niche cabinets;

fitting a plurality of brackets at corners of the front lip, each bracket comprising a plurality of arms and a face plate knob, wherein each of the plurality of arms couples with a respective brace, wherein the face plate knob extends outwardly away from the bracket to support a corner of a face plate, and wherein the face plate knob comprises at least one face plate positioning divider;

covering the front end of each respective stacked niche cabinet with a respective face plate, wherein each face plate is supported and positioned by the face plate knobs on the brackets adjacent to said niche cabinet; and securing the face plates with a plurality of face plate security assemblies, each face plate security assembly attaching to a respective bracket face plate knob and extending over portions of adjacent face plates in order to secure the adjacent face plates against adjacent braces.

2. The method of claim 1, further comprising fastening the braces to one or more of the niche cabinets.

3. The method of claim 1, wherein one or more of the face plate security assemblies comprises a bolt and sleeve assembly, wherein securing the face plates comprises passing the bolt through a hole in the face plate knob to couple with the sleeve disposed in the bracket.

4. The method of claim 1, wherein one or more of the face plate security assemblies comprises a rosette plate which extends over portions of adjacent face plates, and wherein securing the face plates comprises bolting the rosette plates to respective face plate knobs.

5. The method of claim 1, further comprising inserting one or more shims between adjacent niche cabinets.

6. The method of claim 1, wherein the plurality of brackets comprises one or more four arm interior brackets, one or more three arm edge brackets, and one or more two arm corner brackets.

7. The method of claim 1, wherein the at least one face plate positioning divider has a width that substantially matches a height of the face plate knob.

8. The method of claim 1, wherein the at least one face plate positioning divider comprises a triangular shape.

9. The method of claim 1, wherein the front end of one or more of the niche cabinets is angled in order to impart a non-linear shape to the columbarium.

10. The method of claim 9, wherein one or more of the arms of one or more of the brackets is angled in order support the non-linear shape of the columbarium.

* * * * *